US005421047A

United States Patent [19]

Sabia

[11] Patent Number: 5,421,047

[45] Date of Patent: Jun. 6, 1995

[54] PATIENT SUPPORT APPARATUS

[76] Inventor: Annette Sabia, 174 Gillies La., Norwalk, Conn. 06854

[21] Appl. No.: 103,563

[22] Filed: Aug. 9, 1993

[51] Int. Cl.[6] ..... A61G 7/057; A47C 27/00; A47C 3/00

[52] U.S. Cl. ..... 5/632; 5/465; 297/284.3; 297/452.21

[58] Field of Search ..... 5/630, 632, 465, 922, 5/455, 903; 297/284.3, 452.55, 542.21

[56] References Cited

U.S. PATENT DOCUMENTS

| | | | |
|---|---|---|---|
| 3,663,055 | 5/1972 | Gale | 297/284 |
| 4,163,297 | 8/1979 | Neumark | 5/909 |
| 4,336,621 | 6/1982 | Schwartz et al. | 5/465 |
| 4,777,678 | 10/1988 | Moore | 5/465 |
| 4,843,666 | 7/1989 | Elesh et al. | 5/922 |
| 5,020,168 | 6/1991 | Wood | 5/455 |
| 5,288,135 | 2/1994 | Forcier et al. | 5/653 |

FOREIGN PATENT DOCUMENTS

| | | | |
|---|---|---|---|
| 2734460 | 1/1979 | Germany | 5/465 |
| 1052913 | 12/1966 | United Kingdom | 297/452.55 |

*Primary Examiner*—Alexander Grosz
*Attorney, Agent, or Firm*—Francis N. Carten

[57] ABSTRACT

A patient support system comprising a series of self-supporting cushions connected by two longitudinal members and disposed transversely to a bed, with at least two of the cushions spaced longitudinally from one another so as to raise the patient's buttocks above the underlying bed while remaining out of contact therewith. The cushions are contoured so as to raise both the head and the heels of the patient with respect to his/her buttocks, with the heels extending beyond the end cushion to remain out of contact therewith. An embodiment with a reduced number of cushions supports a patient in the sitting position, either in a chair, a wheelchair, or on a backless bench, with the option of having the patient's legs raised on a cushion extension.

16 Claims, 3 Drawing Sheets

PATIENT SUPPORT APPARATUS

BACKGROUND OF THE INVENTION

The formation of decubitus ulcers (bedsores) on patients who are confined to bed for long periods of time is a persistent problem, in spite of many attempts utilizing a variety of approaches to solving this problem. Flotation beds such as water beds, while effective, are very expensive. One alternative to a flotation bed is the mattress disclosed in U.S. Pat. No. 4,163,297 as being formed by a series of partially-filled pillows, each in contact with and supported by the immediately adjacent pillow(s), all disposed on their edges transversely to an underlying bed. The present applicant has devised a more flexible and relatively inexpensive patient support system which, by suitably positioning the component cushions, eliminates pressure on the patient's buttocks and heels, the sites at which bedsores form most persistently.

SUMMARY OF THE INVENTION

The present invention is embodied in and carried out by a patient support system which, in one embodiment, includes a series of self-supporting cushions extending from head to ankles, connected by two longitudinal members and disposed transversely to a bed, with at least two of the cushions spaced longitudinally from one another so as to raise the patient's buttocks above the underlying bed while remaining out of contact therewith. The cushions are contoured so as to raise both the head and the heels of the patient with respect to his/her buttocks, with the heels extending beyond the end cushion to remain out of contact therewith. Another embodiment with a reduced number of cushions extending from shoulders to knees supports a patient in the sitting position, either in a chair, a wheelchair, or on a backless bench, with the option of having the patient's legs raised and supported by an extension from knees to ankles.

DESCRIPTION OF THE DRAWINGS

The written description of the present invention will be more fully understood when read with reference to the accompanying drawings, in which like reference numbers refer to like components in the several drawing figures, and in which.

DETAILED DESCRIPTION OF THE PREFERRED EMBODIMENTS

Figure 1:
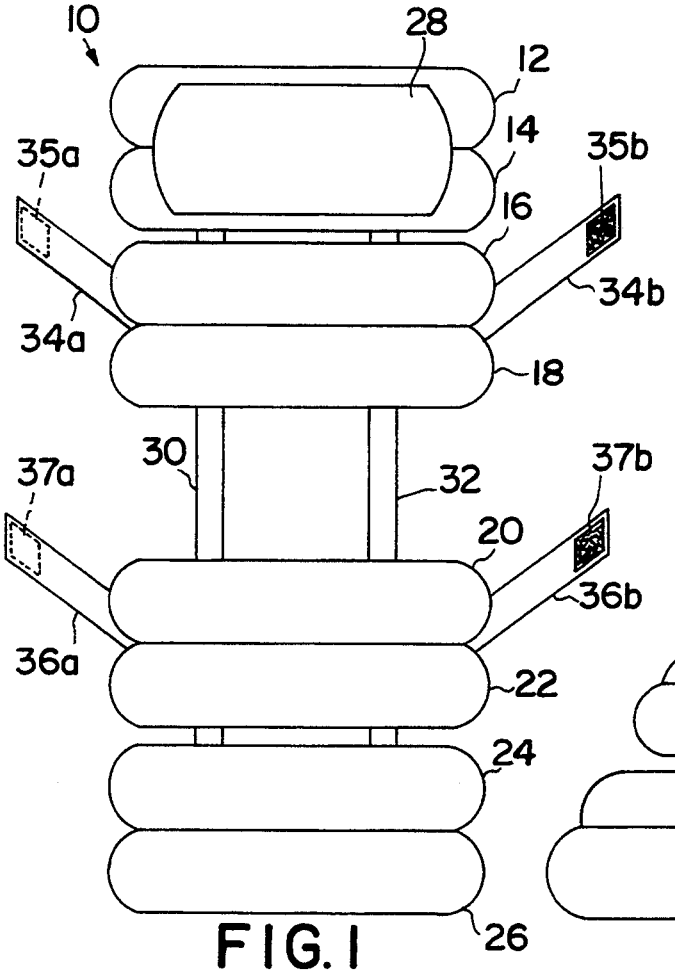
FIG. 1 is a top view of a first preferred embodiment of the patient support system embodying the present invention.
Figure 3:
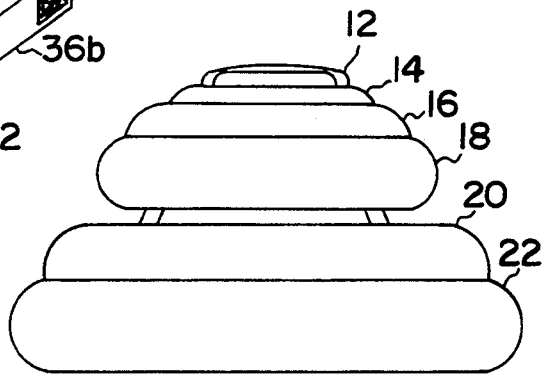
FIG. 3 is a front perspective view of the patient support system of FIG. 1.
Figure 2:
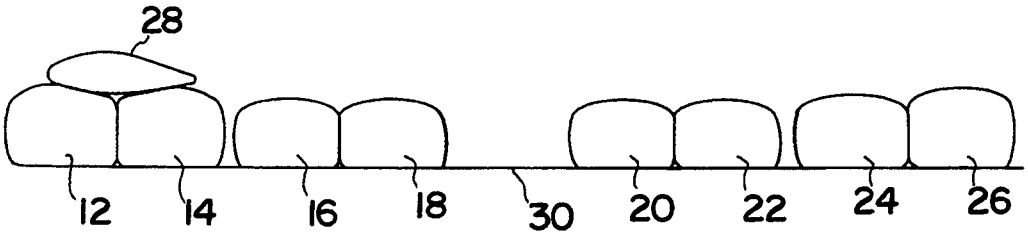
FIG. 2 is a side view of the patient support system of FIG. 1.

The best mode of carrying out the invention is shown in the aforementioned drawing figures and is described in detail hereunder. Referring now specifically to the first preferred embodiment shown in FIGS. 1, 2 and 3, the patient support system 10 comprises a series of cushions 12, 14, 16, 18, 20, 22, 24 and 26, each of which can be filled with air, water, gel, foam (plastic or rubber), or any other suitable filler material, and can incorporate heating elements and/or vibrator elements for comfort and stimulation. The cushions are attached to the pair of flexible parallel support members 30, 32 made of heavy fabric or the like; the support members 30, 32 may be connected to one another so as to maintain their spacing. The form of attachment of the cushions 12–26 to the parallel support members 30, 32 can be permanent (e.g., by stitching), but is preferably removable (e.g., by VELCRO fasteners) (i) to enable variation of the spacing of the cushions with respect to one another to accommodate individual patients and (ii) to facilitate replacement and/or cleaning. When laid flat on a horizontal surface such as a bed, the cushions' upper surfaces slope gradually downward from each end to the center so as to raise both the head and the heels of the patient with respect to his/her buttocks, with the heels extending beyond the end cushion to remain out of contact therewith. An optional pillow 28 can be removably attached to the cushions 12 and/or 14 in the region of the patient's head by means of VELCRO fasteners or the like. Straps 34*a*–34*b* and 36*a*–36*b*, with fastening means such as VELCRO fasteners 35*a*–35*b* and 37*a*–37*b* (respectively) on their free ends, may be provided to secure the patient support system to an underlying platform, such as a bed, cot, or stretcher.

Figure 4:
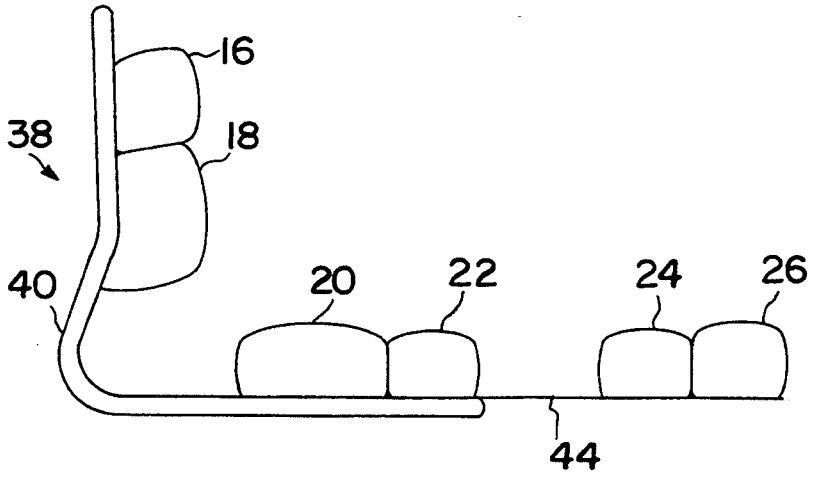
FIG. 4 is a side view of a second preferred embodiment of the patient support system embodying the present invention.
Figure 5:
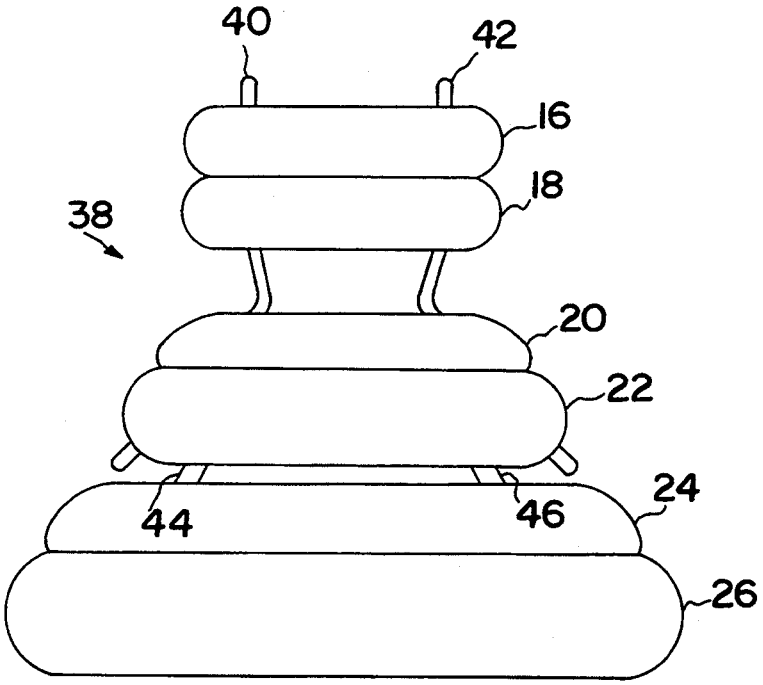
FIG. 5 is a front perspective view of the patient support system of FIG. 4.

Referring now to FIGS. 4 and 5, in the patient support system 38, the head cushions 12 and 14 of the first embodiment have been removed, and the pair of L-shaped parallel support members 40, 42 are preferably formed of a rigid material (e.g., metal or plastic). However, they can be flexible straps made of heavy fabric or the like, and may incorporate means for attachment of the patient support system to supporting vertical and/or horizontal surfaces as in the first embodiment shown in FIGS. 1, 2 and 3. The means of attachment of the cushions 16–22 to the support members 40, 42 can be permanent (e.g., by stitching), but is preferably detachable (e.g., by VELCRO fasteners) (i) to enable variation of the spacing of the cushions with respect to one another to accommodate individual patients and (ii) to facilitate replacement and/or cleaning. The calf cushions 24 and 26 are similarly attached to a pair of separate parallel attachment straps 44, 46, at the ends of which are attachment means (e.g., VELCRO fasteners) to enable optional attachment to one of the thigh cushions 20 or 22 to form part of the patient support system 38. Thus, the calf cushions 24 and 26 can be adjustably spaced from the remainder of the patient support system 38 to accommodate the individual patient.

Figure 7:
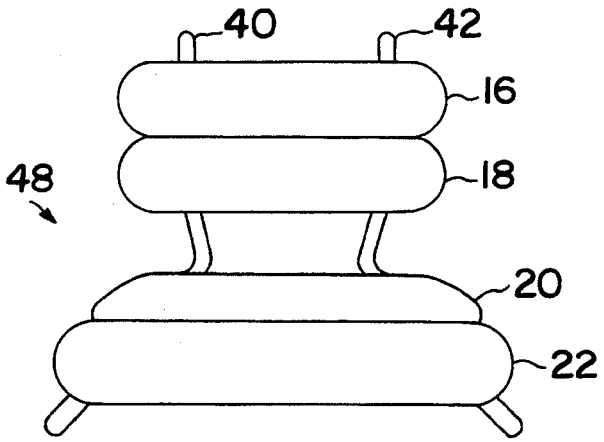
FIG. 7 is a front perspective view of the patient support system of FIG. 6.
Figure 6:
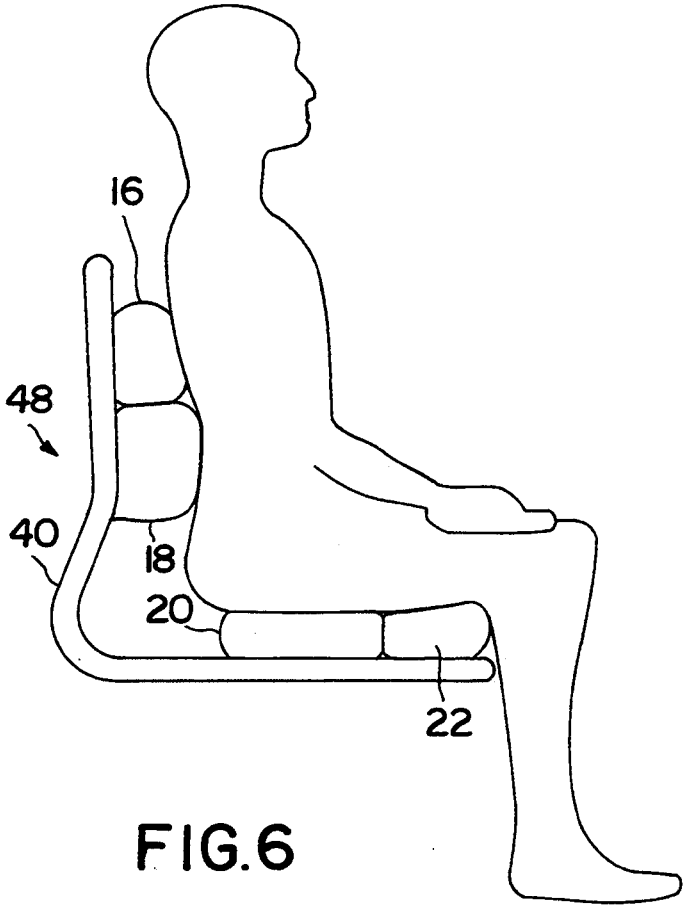
FIG. 6 is a side view of a third preferred embodiment of the patient support system embodying the present invention.

Referring now to FIGS. 6 and 7, in the patient support system 48, the simplest embodiment of the invention is shown as comprising a series of parallel cushions including back cushions 16, 18 and thigh cushions 20, 22 attached to the vertical and horizontal portions (respectively) of a pair of parallel support members 40, 42 to form the patient support system 48. As in the embodiment shown in FIGS. 4 and 5, the pair of support members 40, 42 can be formed of a relatively rigid material such as plastic or metal, or they can be flexible straps made of heavy fabric or the like, and may incorporate means for attachment of the patient support system to supporting vertical and/or horizontal surfaces as in the first embodiment shown in FIGS. 1, 2 and 3. As before, the means of attachment of the cushions 16–22 to the support members 40, 42 can be permanent (e.g., by stitching), but is preferably detachable (e.g., by VELCRO fasteners) (i) to enable variation of the spacing of the cushions with respect to one another to accommodate individual patients and (ii) to facilitate replacement and/or cleaning. As shown in FIG. 6, a seated patient has his/her buttocks out of contact with any part of the patient support system or any underlying platform such as a chair, wheelchair, or bench, thereby avoiding the irritation that can result in bed sores.

The advantages of the present invention, as well as certain changes and modifications to the disclosed embodiment thereof, will be readily apparent to those skilled in the art. It is the applicant's intention to cover all those changes and modifications which could be made to the embodiment of the invention herein chosen for the purposes of the disclosure without departing from the spirit and scope of the invention.

I claim:

1. A patient support system for interposition between a patient and an underlying platform, comprising:

(1) flexible support means;

(2) a plurality of cushions disposed transversely to said flexible support means, two of said cushions being spaced apart above and below the patient's buttocks, whereby the patient's buttocks are not in substantial contact with either of said two cushions and are not in substantial contact with the underlying platform so as to reduce the likelihood of decubitus ulcers; and (3) a plurality of means operative to connect said plurality of cushions to said flexible support means.

2. A patient support system according to claim 1, wherein said plurality of cushions extends from shoulder to knee.

3. A patient support system according to claim 2, wherein said flexible support means comprises first and second parallel, flexible support members.

4. A patient support system according to claim 3, further comprising means to secure the system to an underlying platform.

5. A patient support system according to claim 4, wherein said means to secure the system to an underlying platform comprises first and second laterally-extending straps with connecting means at their free ends.

6. A patient support system according to claim 1, wherein said plurality of cushions extends from shoulder to ankle.

7. A patient support system according to claim 1, wherein said plurality of cushions extends from head to ankle.

8. A patient support system according to claim 7, wherein said plurality of cushions are contoured to raise the patient's head and heels with respect to the patient's buttocks when said system is laid upon a horizontal underlying platform, with the patient's heels extending beyond the end cushion to remain out of substantial contact therewith and out of substantial contact with the underlying platform so as to reduce the likelihood of decubitus ulcers.

9. A patient support system according to claim 8, further comprising a pillow detachably connected to at least one of said cushions in the region of the patient's head.

10. A patient support system according to claim 7, wherein said flexible support means comprises first and second parallel, flexible support members.

11. A patient support system according to claim 7, further comprising means to secure the system to an underlying platform.

12. A patient support system according to claim 11, wherein said means to secure the system to an underlying platform comprises first and second laterally-extending straps, with co-operative parts of a connecting means at their free ends.

13. A patient support system according to claim 12, wherein said connecting means is a VELCRO fastener.

14. A patient support system for interposition between a patient and an underlying platform, comprising:

(1) flexible support means;

(2) a plurality of cushions disposed transversely to said support means and extending from head to ankle, two of said cushions being spaced apart above and below the patient's buttocks, whereby the patient's buttocks are not in substantial contact with either of said two cushions and are not in substantial contact with the underlying platform so as to reduce the likelihood of decubitus ulcers, said plurality of cushions being contoured to raise the patient's head and heels with respect to the patient's buttocks when said system is laid upon a horizontal underlying platform, with the patient's heels extending beyond the end cushion to remain out of substantial contact therewith and out of substantial contact with the underlying platform so as to reduce the likelihood of decubitus ulcers; and (3) a plurality of VELCRO fastener means operative to connect said plurality of cushions to said support means.

15. A patient support system according to claim 14, further comprising means to secure the system to an underlying platform, said means comprising first and second laterally-extending straps with connecting means at their free ends.

16. A patient support system for interposition between a patient and an underlying platform, comprising:

(1) first and second rigid L-shaped parallel support members;

(2) a plurality of cushions disposed transversely to said parallel support members and extending from shoulder to knee, two of said cushions being spaced apart above and below the patient's buttocks, whereby the patient's buttocks are not in substantial contact with either of said two cushions and are not in substantial contact with the underlying platform so as to reduce the likelihood of decubitus ulcers;

(3) a plurality of fastener means operative to connect said plurality of cushions to said parallel support members; and (4) a detachable extension, comprising (i) support extension means and (ii) at least one cushion disposed transversely to said support extension means, extending from the region of the patient's knees to the region of the patient's ankles.

* * * * *